US008208847B2

(12) United States Patent
Harasawa

(10) Patent No.: US 8,208,847 B2
(45) Date of Patent: Jun. 26, 2012

(54) SHEET FOLDING APPARATUS AND IMAGE FORMING APPARATUS

(75) Inventor: Yusuke Harasawa, Saitama (JP)

(73) Assignee: Ricoh Company, Ltd., Tokyo (JP)

( * ) Notice: Subject to any disclaimer, the term of this patent is extended or adjusted under 35 U.S.C. 154(b) by 1165 days.

(21) Appl. No.: 11/934,329

(22) Filed: Nov. 2, 2007

(65) Prior Publication Data

US 2008/0260446 A1 Oct. 23, 2008

(30) Foreign Application Priority Data

Nov. 15, 2006 (JP) ..... 2006-308823

(51) Int. Cl.
*G03G 15/00* (2006.01)

(52) U.S. Cl. ..... 399/408; 399/407; 271/184

(58) Field of Classification Search ..... 399/407, 399/408, 397; 271/184
See application file for complete search history.

(56) References Cited

U.S. PATENT DOCUMENTS

| | | | | |
|---|---|---|---|---|
| 6,729,376 | B1 * | 5/2004 | Kakinuma et al. | 156/521 |
| 7,503,886 | B2 | 3/2009 | Sekine et al. | |
| 7,783,244 | B2 * | 8/2010 | Nagasawa et al. | 399/407 |

FOREIGN PATENT DOCUMENTS

| | | |
|---|---|---|
| JP | 5-52548 | 3/1993 |
| JP | 7-35222 | 2/1995 |
| JP | 8-29884 | 2/1996 |
| JP | 3173121 | 3/2001 |
| JP | 2002-128385 | 5/2002 |
| JP | 2006-130602 | 5/2006 |
| JP | 2006-290618 | 10/2006 |

OTHER PUBLICATIONS

Japanese Office Action issued Mar. 22, 2011, in Patent Application No. 2006-308823.

* cited by examiner

*Primary Examiner* — Judy Nguyen
*Assistant Examiner* — Andy Pham
(74) *Attorney, Agent, or Firm* — Oblon, Spivak, McClelland, Maier & Neustadt, L.L.P.

(57) ABSTRACT

A sheet folding apparatus includes a fan folding unit that fan folds a folded-back sheet into a width or length of the regular size to file the sheet in the regular-size folder such that the sheet forms layers along a traveling direction of the sheet; first and second punching units that punch the filing hole in the sheet fan folded, respectively, into the width and the length of the regular size at the portion to be punched to file the sheet in the regular-size folder; and a sheet-processing setting unit that sets a fold mode of the fan fold and selects one of the first punching unit and the second punching unit for use in punching of the filing hole in the sheet based on a size and orientation of the delivered sheet.

18 Claims, 15 Drawing Sheets

FIG. 11

CORRESPONDENCE AMONG SHEET SIZES, TYPE OF EDGE FOLDING, AND TYPE OF PUNCHING

| SHEET SIZE | EDGE FOLDING | PUNCHING |
|---|---|---|
| A0 VERTICAL | VERTICAL (32L) | VERTICAL (101) |
| A1 VERTICAL | VERTICAL (32L) | VERTICAL (101) |
| A1 HORIZONTAL | HORIZONTAL (32R) | HORIZONTAL (107) |
| A2 VERTICAL | VERTICAL (32L) | VERTICAL (101) |
| A2 HORIZONTAL | HORIZONTAL (32R) | HORIZONTAL (107) |
| A3 VERTICAL | NONE | VERTICAL (101) |
| A3 HORIZONTAL | NONE | HORIZONTAL (107) |
| A4 VERTICAL | NONE | HORIZONTAL (107) |
| A4 HORIZONTAL | NONE | VERTICAL (101) |

SHEET FOLDING APPARATUS AND IMAGE FORMING APPARATUS

CROSS-REFERENCE TO RELATED APPLICATIONS

The present application claims priority to and incorporates by reference the entire contents of Japanese priority document, 2006-308823 filed in Japan on Nov. 15, 2006.

BACKGROUND OF THE INVENTION

1. Field of the Invention

The present invention relates to a sheet folding apparatus that folds a large-sized sheet to file it in a regular-size folder neatly and further punches holes in the sheet for filing, and to an image forming apparatus using the sheet folding apparatus. The present invention relates to, although not intended to limit the invention, a sheet folding apparatus that folds an A2, A1, or A0 size sheet into A4 size and punches holes in the sheet with a puncher for filing the sheet in an A4-size folder. The sheet folding apparatus can be used in a finisher, or a folding apparatus, provided with an edge folding and punching function. The sheet folding apparatus can also be connected and used with a copier, a facsimile, a printer or a plotter.

2. Description of the Related Art

Punchers for punching holes in a sheet at predetermined positions, edge (corner) folding devices that fold an edge of a sheet, and combinations thereof, each of which are to be provided in a sheet folding apparatus, have been proposed in various types. The sheet folding apparatus is connected to an image forming apparatus such as a printer, a copier, or a facsimile, and folds a sheet in a predetermined mode.

Each of Japanese Patent Application Publications Nos. H8-29884, H7-35222, and H5-525548 proposes a sheet folding apparatus capable of folding a sheet of A2 size or smaller into a regular size, punching filing holes in the sheet, and further printing a stamp on the sheet. More particularly, Japanese Patent Application Publication No. H8-29884 discloses a mechanism that folds a sheet into two, Japanese Patent Application Publication No. H7-35222 discloses an edge folding mechanism, and Japanese Patent Application Publication No. H5-52548 discloses a positioning mechanism that positions a sheet to be punched relative to a punching unit, respectively, in detail. Japanese Patent Publication No. 3173121 proposes an edge folding device having a pair of edge folding mechanisms each lifting up a leading end corner of a sheet to be folded to fold back the corner. Japanese Patent Application Laid-open No. 2002-128385 proposes a sheet processor attached to an image forming apparatus and including a punching device that can punches two, three, or more holes in a sheet fed from the image forming apparatus.

However, according to the conventional technique, only a punching device or an edge folding device is mounted on a post-processing apparatus as in the case of, e.g., the sheet post-processing apparatus described in Japanese Patent Application Laid-open No. 2002-128385 that includes the punching device capable of punching two, three, or more holes in a sheet fed from the image forming apparatus, or the edge folding device described in Japanese Patent No. 3173121 that is provided in the sheet folding apparatus for folding a large-sized sheet such as a drawing draft into a small size and folds back an edge (leading end corner) of the sheet. Accordingly, it is necessary to punch holes in the sheet output from the edge folding unit using a puncher or manually to file the sheet in a file (regular-size folder), which places a large burden on an operator.

Because it is necessary for each of the sheet folding apparatuses described in Japanese Patent Application Publications Nos. H8-29884, H7-35222, and H5-525548 to change an orientation of a folded sheet relative to a puncher according to a size of the sheet, each sheet folding apparatus includes a sheet rotating mechanism that rotates (reorients) a sheet by 90 degrees about an axis perpendicular to a sheet plane. For example, an A3 sheet delivered in horizontal orientation or an A4 sheet delivered in vertical orientation is rotated by 90 degrees and thereafter fed to a punching stage. A maximum available sheet for these sheet folding apparatuses is an A2 sheet in vertical orientation (hereinafter, "A2 vertical"). Accordingly, among A2, A3, and other A-sized sheets, sheets that need to be rotated by 90 degrees are only an A3 sheet in horizontal orientation (hereinafter, "A3 horizontal") and an A4 sheet in vertical orientation (hereinafter, "A4 vertical"), which are relatively small-sized sheets. To allow these sheets to be rotated by 90 degrees, a requirement for the sheet folding apparatus is only being capable of accommodating a circle having a diagonal line of an A3 sheet as its diameter therein. Hence, an increase of the sheet folding apparatus in size can be suppressed. However, in a sheet folding apparatus of which maximum processable sheet is an A0 sheet in vertical orientation (hereinafter, "A0 vertical"), the sheet folding apparatus is required to be capable of accommodating a circle having a diagonal line of the A1 sheet as its diameter to allow an A1 sheet to be rotated in horizontal orientation. To meet this requirement, the sheet folding apparatus must be significantly increased in size.

SUMMARY OF THE INVENTION

It is an object of the present invention to at least partially solve the problems in the conventional technology.

According to an aspect of the present invention, a sheet folding apparatus includes an edge folding unit that folds back a portion on a leading end of a delivered sheet that is to be folded into a regular size and perforated with a filing hole to file the sheet in a regular-size folder, wherein the portion would otherwise block a portion to be punched when the sheet has been folded. The sheet folding apparatus also includes a fan folding unit that fan folds the folded-back sheet into a width or length of the regular size to file the sheet in the regular-size folder such that the sheet forms layers along a traveling direction of the sheet; a first punching unit that punches the filing hole in the sheet fan folded into the width of the regular size at the portion to be punched to file the sheet in the regular-size folder; a second punching unit that punches the filing hole in the sheet fan folded into the length of the regular size at the portion to be punched for filing in the regular-size folder; and a sheet-processing setting unit that sets a fold mode of the fan fold and selects one of the first punching unit and the second punching unit for use in punching of the filing hole in the sheet based on a size and orientation of the delivered sheet.

According to another aspect of the present invention, a sheet folding apparatus includes a corner-fold transport path unit that transports a delivered sheet in a vertical direction while aligning a center line thereof to a center line of the corner-fold transport path; a first edge-folding unit that folds back a left corner, in relation to the center line, on a leading end of the sheet that is transported in the vertical direction and to be folded into a regular size and perforated with a filing hole to file the sheet in a regular-size folder, wherein the left corner would otherwise block a portion to be punched when the sheet has been folded; a second edge-folding unit that folds back a right corner in relation to the center line on the leading end of the vertically transported sheet, wherein the sheet is to be folded into a regular size and perforated with a hole for filing in a regular-size folder, wherein the right corner would otherwise block a portion to be punched when the sheet has been folded; a fan folding unit that fan folds the folded-back sheet into a width or length of the regular size for filing in the regular-size folder such that the sheet forms layers along a traveling direction of the sheet; a transport-direction changing unit that changes the transport direction of the sheet having been fan-folded into the width or length of the regular size from the vertical direction to a first horizontal direction and then discharges the sheet; a transport unit that transports the sheet discharged in the first horizontal direction along a transport path surface extending in a second horizontal direction perpendicular to the first horizontal direction; a first punching unit that includes a puncher that perforates a plurality of holes arranged in the second horizontal direction and a drive unit that moves the puncher back and force in a direction along the transport-path surface and perpendicular to the second horizontal direction; a path switching unit that selectively switches the transport direction of the sheet transported along the transport-path surface in the second horizontal direction to a direction perpendicular to the transport-path surface; a second punching unit that includes a fixedly positioned puncher, the puncher receiving the leading end of the sheet of which transport direction has been switched by the path switching unit and punching a plurality of holes arranged in a direction perpendicular to the second direction therein; and a sheet-processing setting unit that selects one of the first edge-folding unit and the second edge-folding unit for use in the corner fold, sets a fan fold mode, and selects one of the first punching unit and the second punching unit for use in punching of the filing hole based on a size and an orientation of the sheet.

According to still another aspect of the present invention, an image forming apparatus includes an edge folding unit that folds back a portion on a leading end of a delivered sheet that is to be folded into a regular size and perforated with a filing hole to file the sheet in a regular-size folder, wherein the portion would otherwise block a portion to be punched when the sheet has been folded; a fan folding unit that fan folds the folded-back sheet into a width and length of the regular size to file the sheet in the regular-size folder such that the sheet forms layers along a traveling direction of the sheet; a first punching unit that punches the filing hole in the sheet fan folded into the width of the regular size at the portion to be punched to file the sheet in the regular-size folder; a second punching unit that punches the filing hole in the sheet fan folded into the length of the regular size at the portion to be punched for filing in the regular-size folder; a sheet-processing setting unit that sets a fold mode of the fan fold and selects one of the first punching unit and the second punching unit for use in punching of the filing hole in the sheet based on a size and orientation of the delivered sheet; a connecting transport unit that receives the sheet horizontally discharged from an image forming apparatus, and delivers the sheet to the edge-fold transport path of the edge-folding unit; and an imaging device that forms an image on a sheet larger than the regular size and outputs the sheet with image to the connecting transport unit.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 11 is a correspondence table of sheet sizes, edge fold, and punching to be processed by the sheet folding apparatus shown in FIG. 1;

DETAILED DESCRIPTION OF THE PREFERRED EMBODIMENTS

Exemplary embodiments of the present invention will be explained below in detail with reference to the accompanying drawings.

Figure 1:
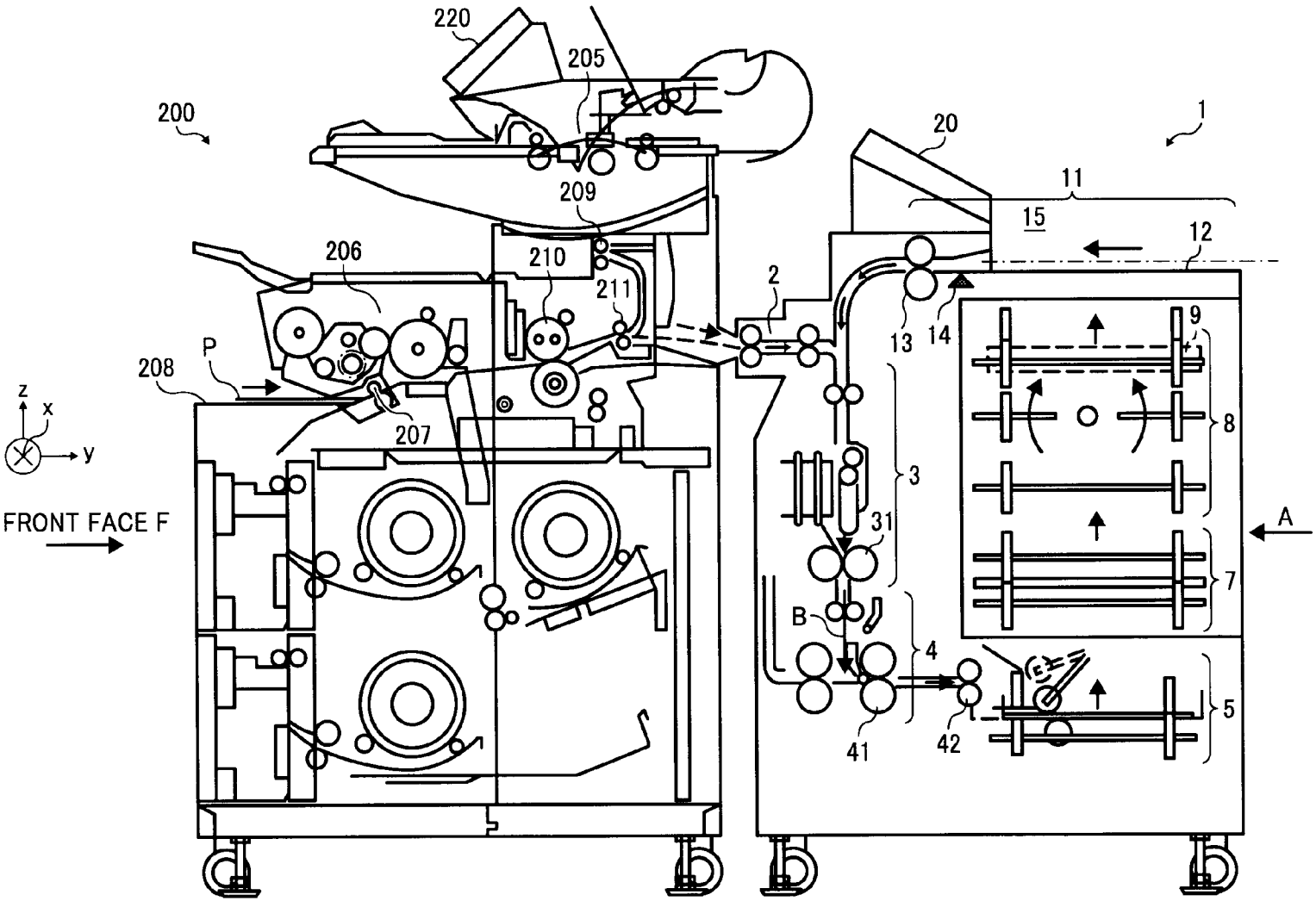
FIG. 1 is a lateral schematic cross section of a sheet folding apparatus according to an embodiment of the present invention and a copier that delivers a sheet to the sheet folding apparatus.
Figure 2:
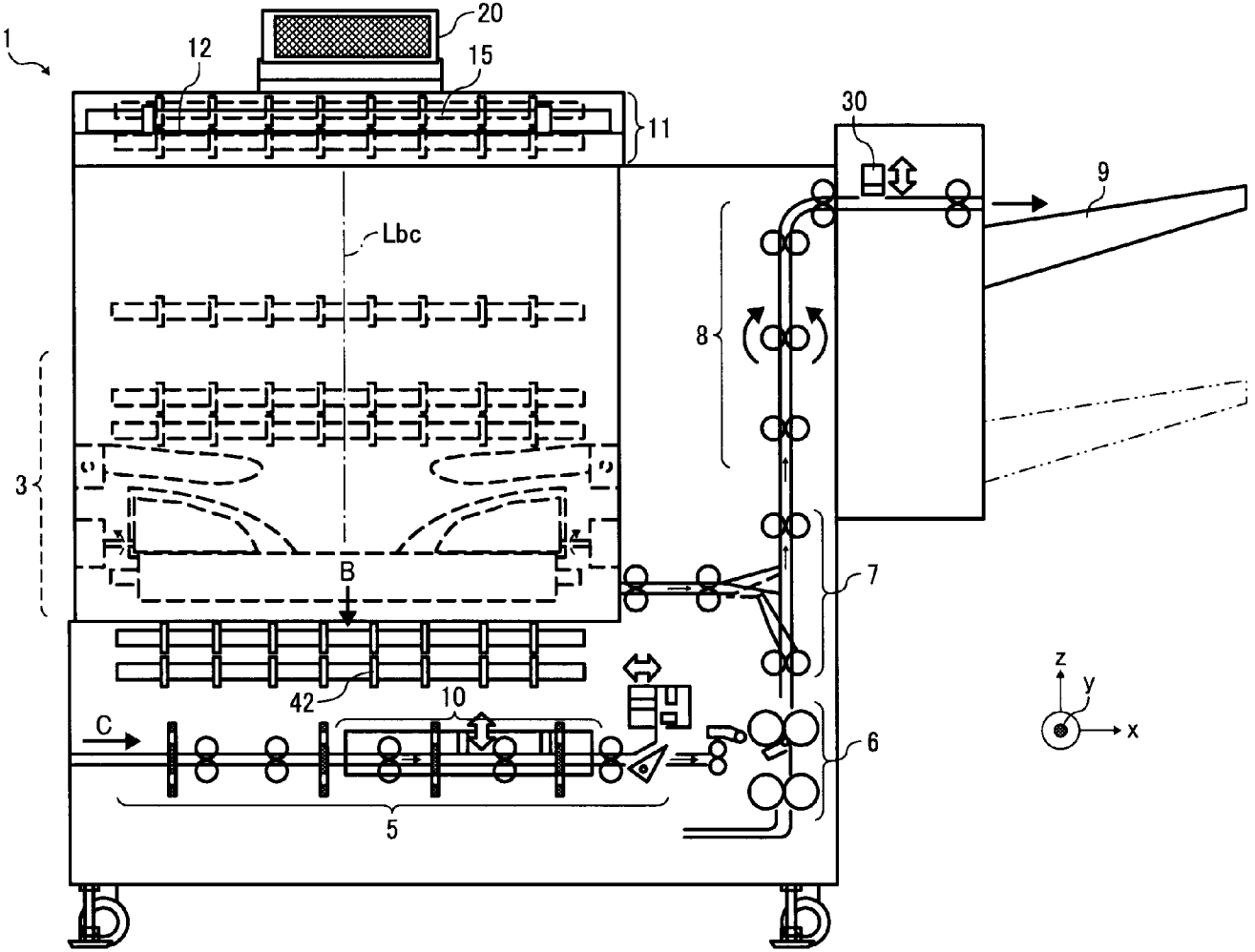
FIG. 2 is an enlarged longitudinal schematic cross section of the sheet folding apparatus shown in FIG. 1, as viewed from a direction indicated by an arrow A.

FIG. 1 is a schematic longitudinal cross section of a sheet processor according to an embodiment of the present invention. FIG. 2 is a partial overview of a mechanism of a sheet folding apparatus 1 shown in FIG. 1, as viewed from a direction indicated by an arrow A in FIG. 1; that is, from a backside. Reference numeral 200 denotes a copier, which is an embodiment of an imaging device. The sheet folding apparatus 1 is connected to a back surface of the copier 200. The sheet folding apparatus 1 includes a connecting transport path 2 serving as a first sheet inlet for "online-fold" mode, an edge folding mechanism 3, a fan folding mechanism 4, a transport-path switching mechanism 5, a cross folding mechanism 6 (FIG. 2), a reversing mechanism 7, a rotating mechanism 8, and a tray 9. A sheet onto which an image is transferred in the copier 200 is fed to the sheet folding apparatus 1 through the connecting transport path 2. The edge folding mechanism 3 folds a leading end of the sheet. The fan folding mechanism 4 fan-folds a sheet in a transport direction of the sheet. The transport-path switching mechanism 5 switches a transport direction of a fan-folded sheet. The cross folding mechanism 6 folds the sheet of which transport direction has been switched. The reversing mechanism 7 turns over the sheet (switching a leading end and a trailing end of the sheet in the transport direction) having been folded into A4 size in the cross folding mechanism 6. The rotating mechanism 8 turns an orientation of the sheet by 90 degrees. The transport-path switching mechanism 5 includes a punching device 10 that punches holes in a lengthwise edge (a side parallel with a transport direction C) or in a widthwise edge (a side perpendicular to the transport direction C) of a sheet. The transport-path switching mechanism 5 further includes, at a position immediately upstream from the tray 9, a stamper 30 that prints a stamp on a folded sheet.

The sheet folding apparatus 1 has a manual feed section 11 formed with a manual feed table 12 serving as a second sheet inlet for "offline fold" mode. Hence, a sheet can be inserted into a horizontal manual-feed port 15 (FIG. 2) without passing through the copier 200 (offline).

In the "online fold" mode, a sheet, onto which an image is transferred in the copier 200, is fed to the connecting transport path 2 in the sheet folding apparatus 1. An operator changes settings for the "online fold" mode on a control display board 220 provided on the copier 200. In the "offline fold" mode, a sheet is fed via the manual feed section 11 to the sheet folding apparatus 1 and folded therein without passing through the copier 200. An operator changes settings related to the "offline fold" mode on a control display board 20 provided on the sheet folding apparatus 1.

Operations performed in the "online fold" mode, in which a sheet, onto which an image has been transferred in the copier 200, is fed to the sheet folding apparatus 1 and folded, will be described below. First, an operator inputs a sheet size, fold type, and the like on the control display board 220 provided on the copier 200. The copier 200 includes an image reading device (document scanner) 205 and a manual feed table 208 below the image reading device 205. When a recording sheet is positioned on the manual feed table 208, the sheet is temporarily held by registration rollers 207, and after a timed interval fed to an image-forming unit 206. A sheet of a specified size can be cut out from a roll of paper (of sheet width) stored in a paper roll stocker below the manual feed table 208. When the operator selects automatic sheet feed mode, the specified size of sheet is cut out from the roll of paper, and then fed to the registration rollers 207 that temporarily holds the sheet. After a timed interval, the sheet is fed to the image-forming unit 206.

The image-forming unit 206 forms a latent image on a photoconductor (not shown) corresponding to image data, develops the latent image with toner, and transfers the toner image on the sheet. A fuser 210 fuses (fixes) the toner image on the sheet. The recorded sheet onto which the toner is fixed by the fuser 210 is discharged to the sheet folding apparatus 1 by recorded-sheet discharge rollers 211 when any one of folding, punching, and stamping is to be performed on the sheet. When none of folding, punching, and stamping is to be performed on the sheet, a switching lug (not shown) and upper discharge rollers 209 discharge the recorded sheet to a portion below the image reading device 205.

When the sheet is to be folded, the recorded-sheet discharge rollers 211 conveys the sheet to the sheet folding apparatus 1 through the connecting transport path 2 to the edge folding mechanism 3. When the sheet is to be folded at its edge, any one of a right-edge folding mechanism positioned on the right relative to a transport direction and a left-edge folding mechanism positioned on the left of the edge folding mechanism 3 folds a leading end of the sheet. During the edge folding process, the sheet is folded at a corner on the leading end (that is, "edge fold" means "corner fold"). After being folded at the corner on the leading end by the edge folding mechanism 3, the sheet is fan or bellows folded by the fan folding mechanism 4 in the transport direction, and transported to the transport-path switching mechanism 5.

Operations related to the sheet at the transport-path switching mechanism 5 and subsequent thereto will be described with reference to FIG. 2, which is a view of the sheet folding apparatus 1 as viewed from the direction indicated by the arrow A in FIG. 1. In the transport-path switching mechanism 5, skewing of the sheet is corrected by a jogger unit (not shown). If punching is selected, either one of a longitudinal puncher 101 positioned off to the side relative to the transport direction C and a lateral puncher 107 positioned off to the front is actuated to punch the fan-folded sheet. The sheet is then transported to the cross folding mechanism 6.

In the cross folding mechanism 6, the fan-folded sheet is further folded perpendicularly to the fan folding. The large-sized sheet is thus eventually folded into A4 size (regular size). Meanwhile, the A4 size is a general finished size in sheet folding, however, a sheet can be folded into a size other than the A4 size.

The sheet folded into the A4 size is reversed by the reversing mechanism 7 as required by a fold type so that the image-transferred side faces downward when discharged into the tray 9, and further rotated clockwise or counterclockwise by 90 degrees by the rotating mechanism 8 as required so that each sheet is oriented in a same direction in the tray 9. If stamping is selected, the sheet is temporarily stopped at a position of the stamper 30 to receive stamping, and thereafter discharged onto the tray 9.

Operations to be performed in the "offline fold" mode in which a sheet to be folded is directly fed to the sheet folding apparatus 1 via the manual feed section 11 without passing through the copier 200 will be described. An operator places a sheet to be folded on the manual feed table 12 shown in FIG. 1 and inserts the sheet in a direction indicated by an arrow in FIG. 1. Upon detection of the sheet with a sheet size sensor 14, the sheet folding apparatus 1 rotates manual transport rollers 13 after a lapse of a timed interval from the detection to nip the sheet P between the manual transport rollers 13, and temporarily stops the rotation. The operator subsequently sets a size, fold type, and the like of the sheet on the control display board 20 provided on the sheet folding apparatus 1, and presses a start button. Accordingly, the sheet folding apparatus 1 rotates the manual transport rollers 13 again to transport the sheet P in the direction indicated by the arrow, thereby feeding the sheet to the edge folding mechanism 3. Operations subsequent thereto are identical to those performed in the "online fold" mode.

Figure 3:
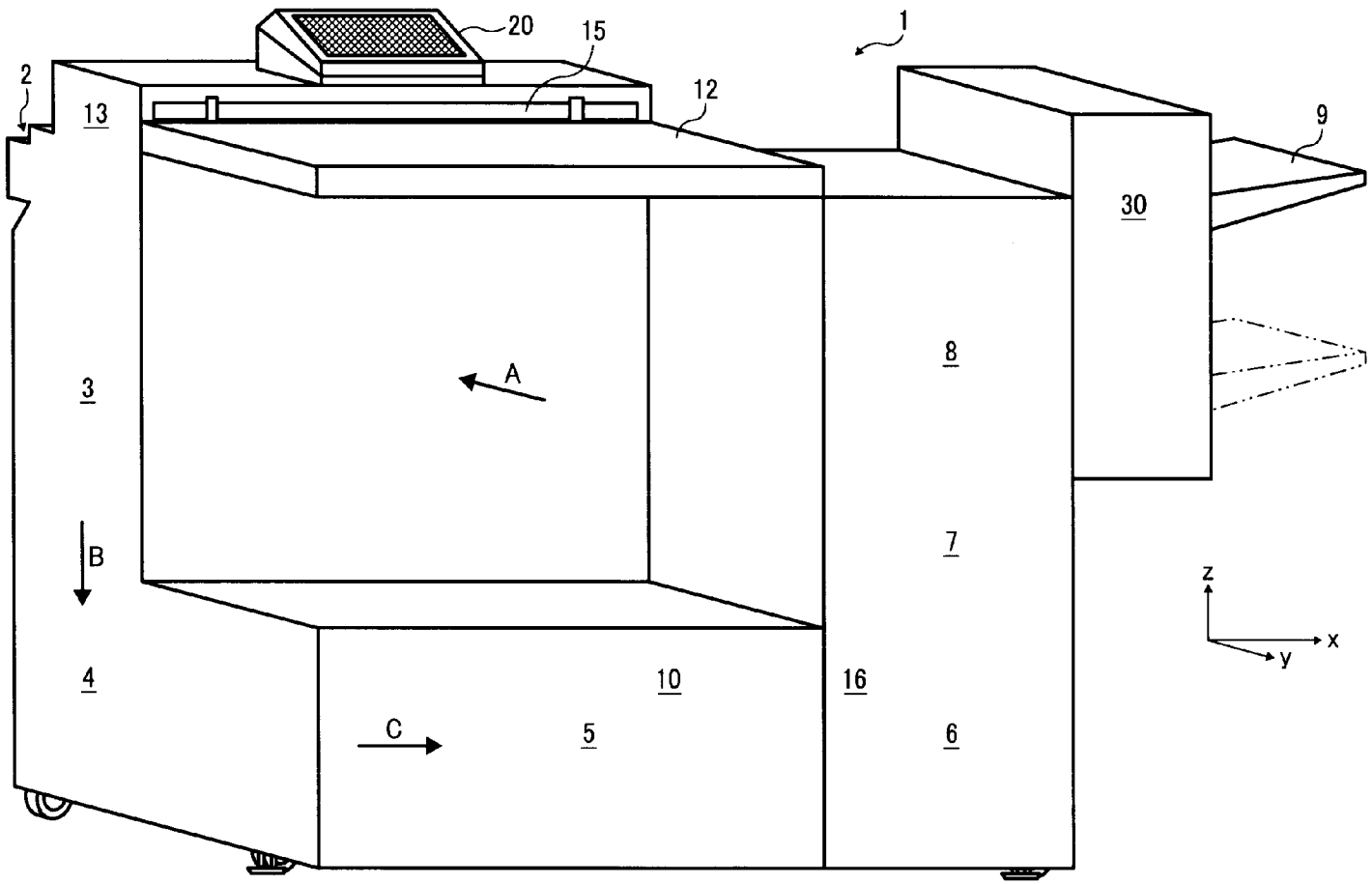
FIG. 3 is an enlarged perspective view of an appearance of the sheet folding apparatus shown in FIG. 1.

FIG. 3 is an overview of only the sheet folding apparatus 1 shown in FIGS. 1 and 2. FIG. 1 depicts the sheet folding apparatus 1 in a cross section of an L-shaped casing shown in FIG. 3 and that of a rectangular solid casing each taken along y-z plane. The L-shaped casing houses a sequence of the horizontal manual-feed port 15, the edge folding mechanism 3, the fan folding mechanism 4, the transport-path switching mechanism 5, and the like therein. The rectangular solid casing houses a sequence of the transport-path switching mechanism 5, the cross folding mechanism 6, the reversing mechanism 7, the rotating mechanism 8, and the like therein. FIG. 2 depicts the sheet folding apparatus 1 in a cross section of the L-shaped casing shown in FIG. 3 that houses the transport-path switching mechanism 5, the cross folding mechanism 6, the reversing mechanism 7, the rotating mechanism 8, and the like taken along x-z plane.

Figure 4:
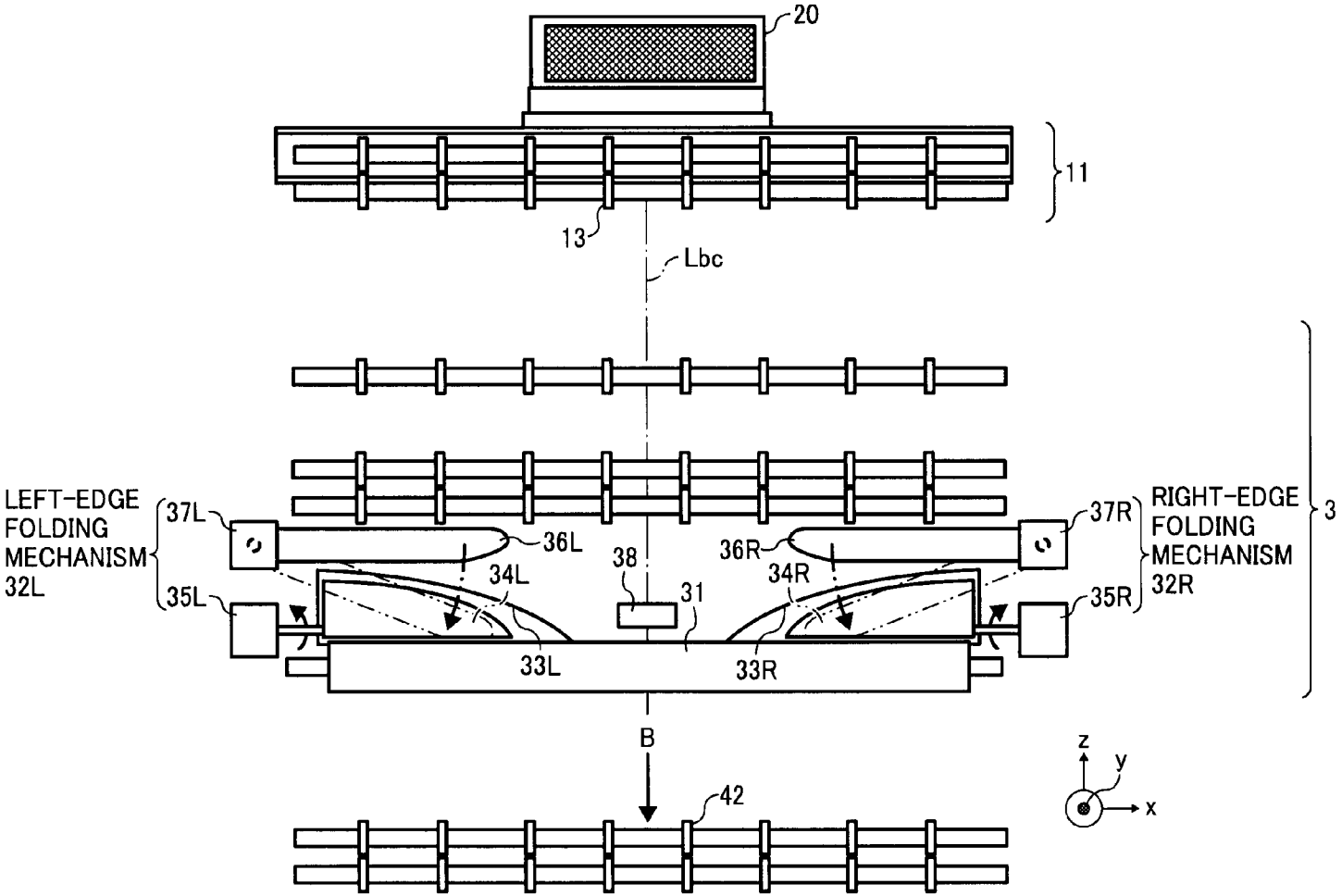
FIG. 4 is an enlarged plan view of an edge folding mechanism shown in FIG. 1, as viewed from the direction indicated by the arrow A.

FIG. 4 is an enlarged view of the edge folding mechanism 3 as viewed from the direction indicated by the arrow A in FIG. 1. A sheet fed from the connecting transport path 2 or the horizontal manual-feed port 15 is transported in a vertically downward direction B such that a center line of the transport path aligns with that of the sheet. More specifically, the sheet is transported in the downward direction B such that a center line of left and right edges of the sheet in FIG. 4 aligns with a transport center line Lbc of left and right edges of the transport path extending in the vertical direction B. A pair of edge folding rollers 31 arranged to face each other in the "y" direction and contacting with each other are provided in the edge folding mechanism 3 at its lower end in the sheet transport direction B. The left-edge folding mechanism 32L, which is a first edge-folding mechanism, is provided on a left end of the edge folding mechanism 3 at a portion immediately upstream from the edge folding rollers 31, and the right-edge folding mechanism 32R, which is a second edge folding mechanism, is provided on a right end of the same.

A lift-up plate 34L of the left-edge folding mechanism 32L has a substantially triangular shape to be inserted under a back face of the sheet at a left corner on the leading end to lift it up. A transport guide plate guides the sheet in the transport direction B while supporting the sheet from the backside. An opening 33L is defined in the transport guide plate such that the opening 33L receives the lift-up plate 34L without inhibiting rotation of the lift-up plate 34L about its horizontal shaft. A lift-up driver 35L rotates the horizontal shaft attached to the lift-up plate 34L about a rotary center of the horizontal shaft. An insertion driver 37L causes an inserting spatula 36L provided upstream of the lift-up plate 34L to pivot from a position indicated by a solid line in FIG. 4 to a position indicated by a long dashed double-dotted line toward a nip portion (opposed contacting portion) between the pair of edge folding rollers 31. At the position indicated by the solid line (position elevated from a surface of the guide plate by a large distance; that is, a position separated from the guide surface), the inserting spatula 36L is situated not to inhibit movement of the sheet being fed to the edge folding rollers 31. In contrast, at the position indicated by the long dashed double-dotted line, the insertion driver 37L and a pivot shaft are slightly tilted so that the inserting spatula 36L is lowered to a height (with respect to the guide plate) of the nip portion between the edge folding rollers 31. A sheet sensor 38 that detects arrival of the leading end of the sheet is provided near the edge folding rollers 31. When the sheet is to be folded at the left corner on the leading end (also referred to as triangular fold), a left-edge folding driver 32LD (FIG. 8) energizes the lift-up driver 35L to rotate the lift-up plate 34L, thereby lifting up the sheet after a lapse of an appropriate period of time from detection of the leading end of the sheet by the sheet sensor 38. The left-edge folding driver 32LD then energizes the insertion driver 37L, thereby causing the inserting spatula 36L to pivot toward the nip portion between the edge folding rollers 31. Consequently, the left corner on the leading end of the sheet is folded back, and the edge folding rollers 31 nip a U-shaped bottom of the thus-folded sheet between the nip portion. Because the nipped portion of the sheet ranges from a position near the center line Lbc away from a leading end of the lift-up plate 34L and that of the inserting spatula 36L, the folded area assumes a triangular shape of which longer side extends in the "x" direction and shorter side extends in the "z" direction. That is, corner fold is performed by the edge folding process.

The right-edge folding mechanism 32R is symmetric with the left-edge folding mechanism 32L about the center line Lbc, and the configuration of and operations performed by the right-edge folding mechanism 32R are identical to those of the left-edge folding mechanism 32L. More specifically, the configuration of the right-edge folding mechanism 32R are those of the left-edge folding mechanism 32L of which "left" is replaced with "right" and "L" is replaced with "R."

After the sheet has moved past the edge folding device 3 (edge folding stage) in the direction B and further past the fan folding mechanism 4, the sheet is switched in terms of a traveling direction from the downward vertical direction B to a first horizontal direction by a roller pair 41 provided most downstream in the fan folding mechanism 4. Subsequently, the sheet is fed onto a lateral transport-path surface 51, and positioned by a registration roller (not shown) at a location corresponding to its sheet size in the first horizontal direction, and stopped.

Figure 5:
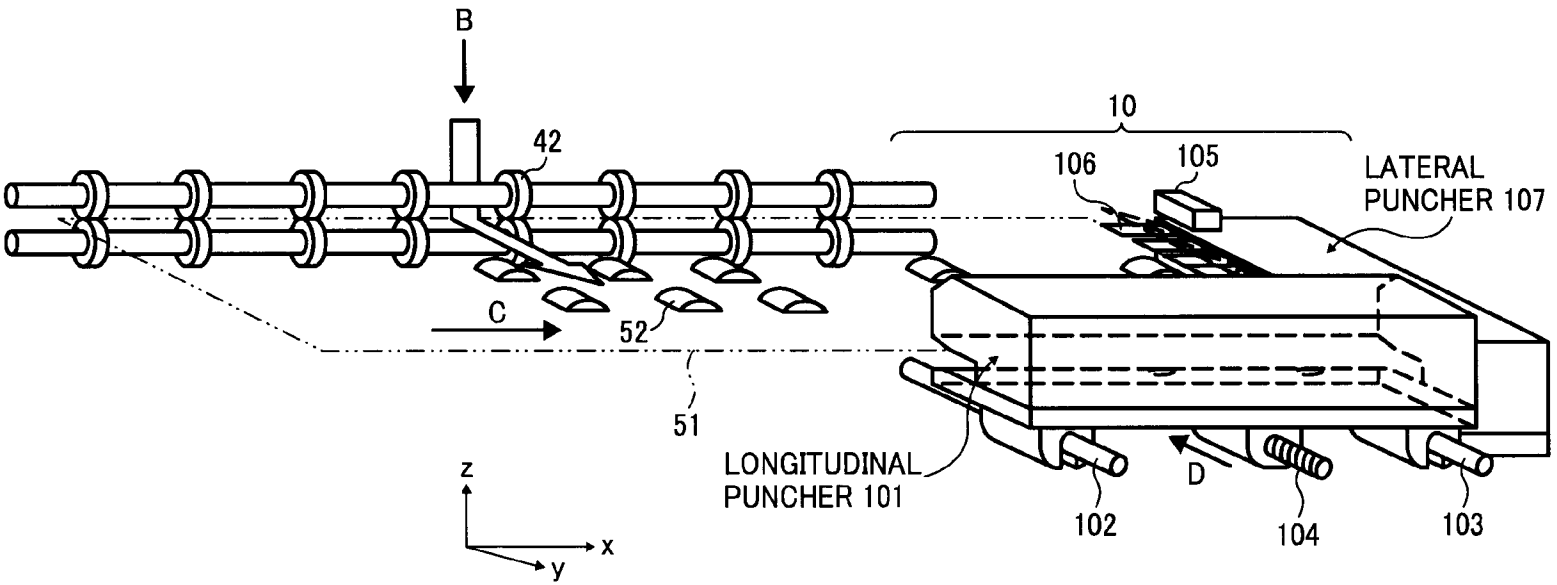
FIG. 5 is an enlarged perspective view of an appearance of a punching device shown in FIG. 2.
Figure 6:
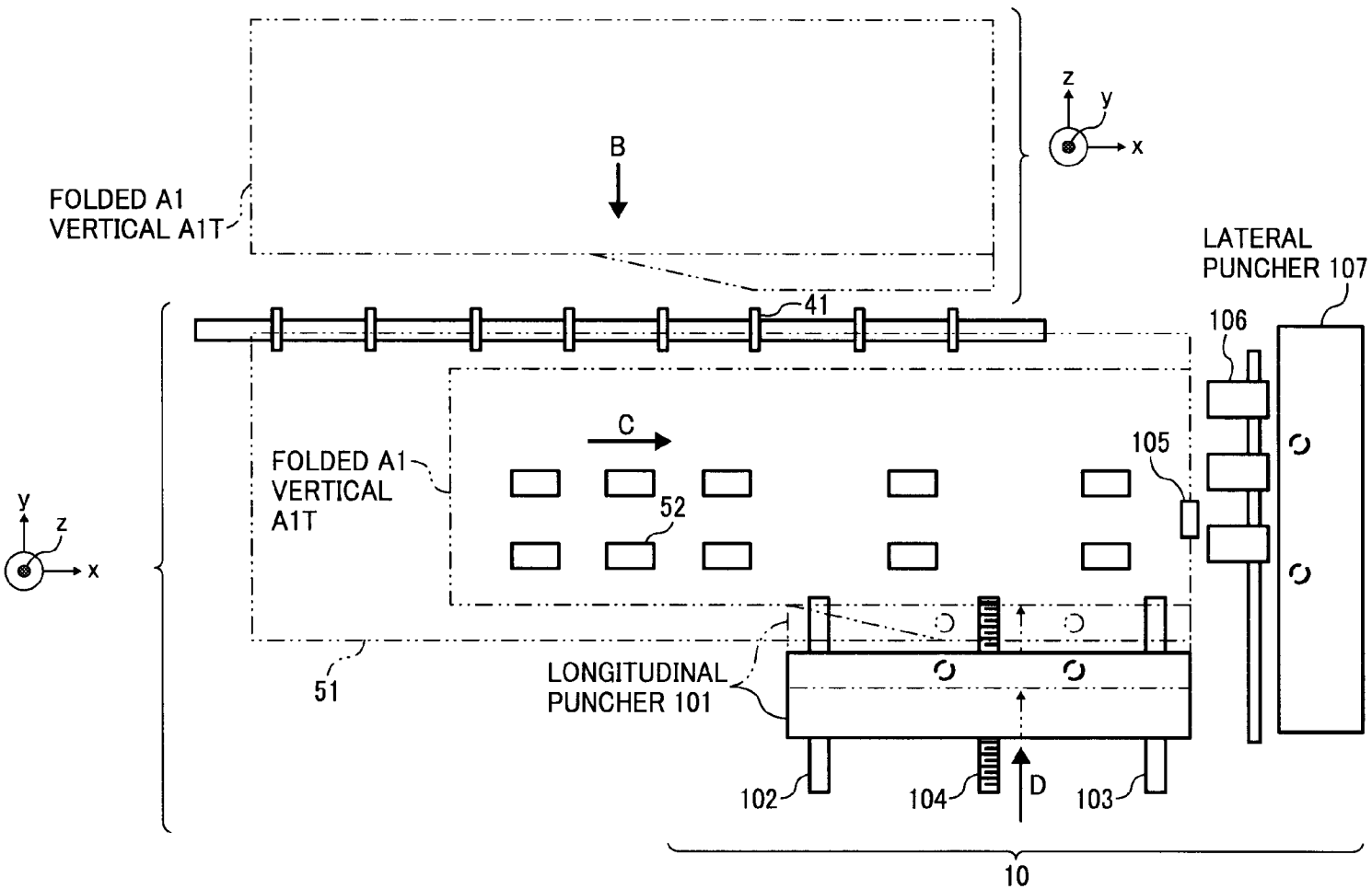
FIG. 6 is a plan view of the punching device shown in FIG. 5, depicting a relative positional relationship between an A1 sheet in vertical orientation (hereinafter, "A1 vertical", indicated by a long dashed double-dotted line) and a puncher that punches holes therein.
Figure 7:
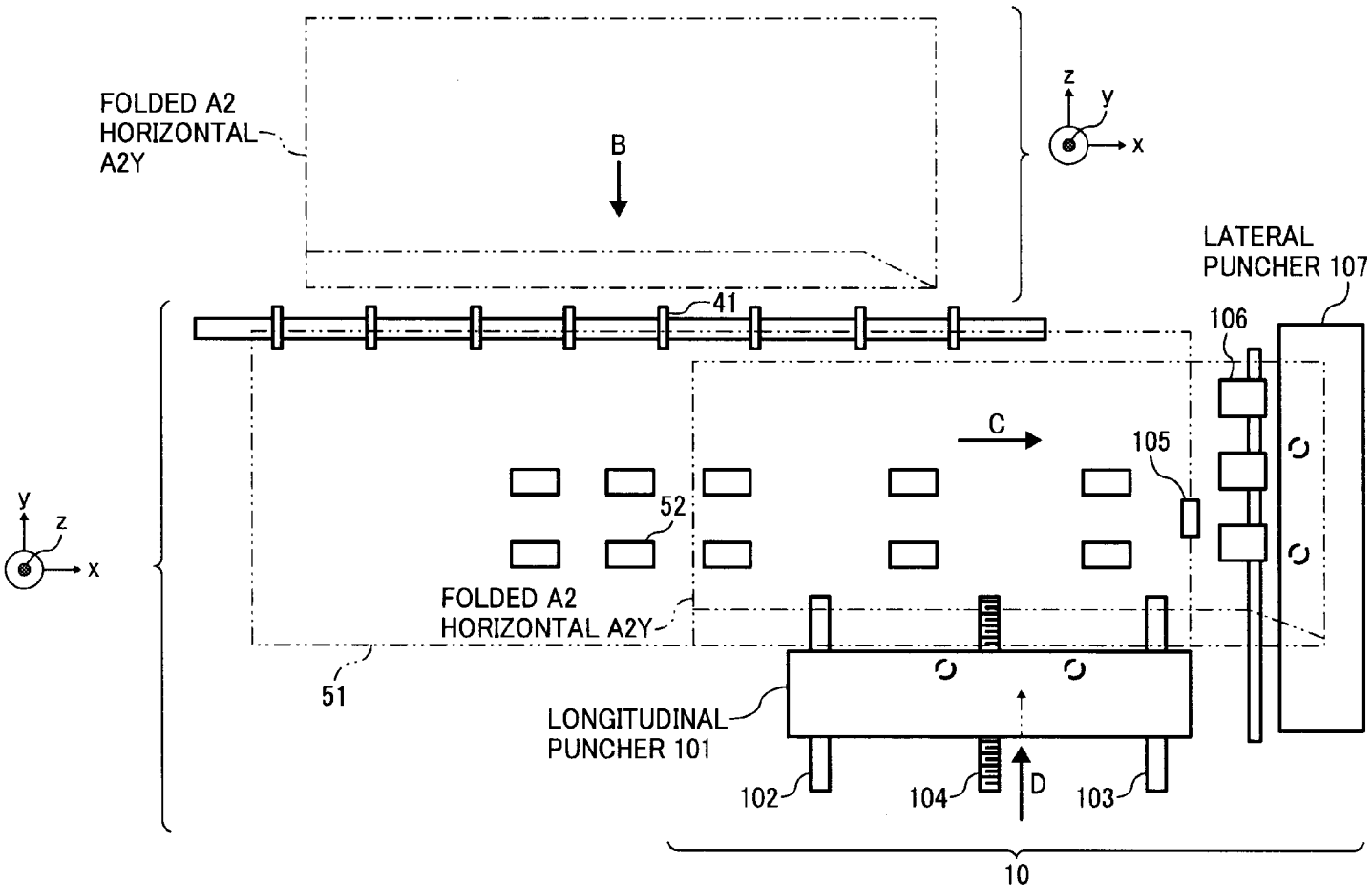
FIG. 7 is a plan view of the punching device shown in FIG. 5, depicting a relative positional relationship between an A2 sheet in horizontal orientation (hereinafter, "A2 horizontal", indicated by a long dashed double-dotted line) and a puncher that punches holes therein.

FIG. 5 is a view of an appearance of the punching device 10. FIGS. 6 and 7 are top views of the punching device 10. When the sheet is delivered onto the lateral transport-path surface 51, lateral transport rollers 52 in the lateral transport-path surface 51 are driven to feed the sheet on the lateral transport-path surface 51 in a second horizontal direction C. When a sheet sensor 105 above a downstream end of the lateral transport-path surface 51 detects the leading end of the sheet, conveyance of the sheet in the second horizontal direction C is temporarily stopped.

The longitudinal puncher 101, which is a first punching unit, is positioned off to the side of the lateral transport-path surface 51. The longitudinal puncher 101 punches a pair of holes (two holes) in the sheet when a binding margin, which is to be positioned on a longer side of a finished, or fan-folded, sheet, extends in the second horizontal direction C on the lateral transport-path surface 51. The "y" direction intersects perpendicularly with the second horizontal direction C at different positions on the longer side depending on the sheet size. To accommodate this variation, the longitudinal puncher 101 is supported by a "y" drive mechanism and driven back and force in the "y" direction. That is, the longitudinal puncher 101 is supported by two guide bars 102 and 103 each extending in the "y" direction to be movable in the "y" direction. When a screw rod 104 connected to a rotator (not shown) and extending in the "y" direction rotates forward, the longitudinal puncher 101 is moved from a retracted position indicated by a solid line in FIG. 6 to a punching position indicated by a long dashed double-dotted line; whereas backward rotation of the screw rod 104 causes the longitudinal puncher 101 to return to the retracted position. The punching positions are prepared in the number of two or more to correspond to a plurality of sheet sizes. FIG. 6 depicts punched positions, perforated by the longitudinal puncher 101, indicated by a long dashed double-dotted line, in a sheet of A1 vertical (A1T) having been fed to the sheet folding apparatus 1 in vertical orientation and fan-folded therein.

A downward transport path is provided downstream of the terminal end of the lateral transport-path surface 51, and path switching lugs 106 are provided at an inlet of the downward transport path. The path switching lugs 106 are fixed to a rotary shaft that extending in the "y" direction. The rotary shaft is coupled to the rotator (not shown). As the rotary shaft rotates forward, the path switching lugs 106 are rotated to tilt up into a guiding orientation indicated by a dotted line in FIG.

5. When the sheet is further conveyed in the second horizontal direction C, the path switching lugs 106 guide the sheet to the downward transport path. The lateral puncher 107, which is a second punching unit, is provided at a position to receive a leading end of the sheet delivered downward along the downward transport path. The lateral puncher 107 punches two holes in the sheet when a binding margin, which is to be positioned on a longer side of a finished, or fan-folded, sheet, extends perpendicular to the second horizontal direction C on the lateral transport-path surface 51 (FIG. 7). The lateral puncher 107 is fixedly positioned. FIG. 7 depicts punched positions, indicated by a long dashed double-dotted line, perforated by the lateral puncher 107 in an A1 sheet in horizontal orientation (hereinafter, "A1 horizontal") A2Y having been fed to the sheet folding apparatus 1 in horizontal orientation and fan-folded therein. After being punched by the lateral puncher 107, the sheet is moved back to return on the downward transport path. When the leading end (the binding margin in which holes are punched) of the sheet passes below the sheet sensor 105, the returning movement of the sheet is stopped.

The punched sheet of which leading end is immediately below the sheet sensor 105 is conveyed in the second horizontal direction C again to pass above upper surfaces of the path switching lugs 106 in the facing-down orientation indicated by a solid line in FIG. 5 and fed to the cross folding mechanism 6. In the cross folding mechanism 6, the sheet having been fan folded and punched is folded into a length or width of A4 size for filing the sheet in an A4 folder, and then transported vertically upward. Subsequently, the thus-obtained A4-sized sheet is horizontally turned by the reversing mechanism 7 as required by its fold type, and returned to the vertically upward transport path with its rear end positioned at a leading end. The rotating mechanism 8 rotates the sheet by 90 degrees clockwise or counterclockwise as required by the fold type so that each sheet is oriented identically when output onto the tray 9. After the transport direction is switched from the vertically upward direction to the horizontal direction, a stamp is printed on the sheet in the stamper 30 when stamping is selected, and delivered onto the tray 9.

Figure 8:
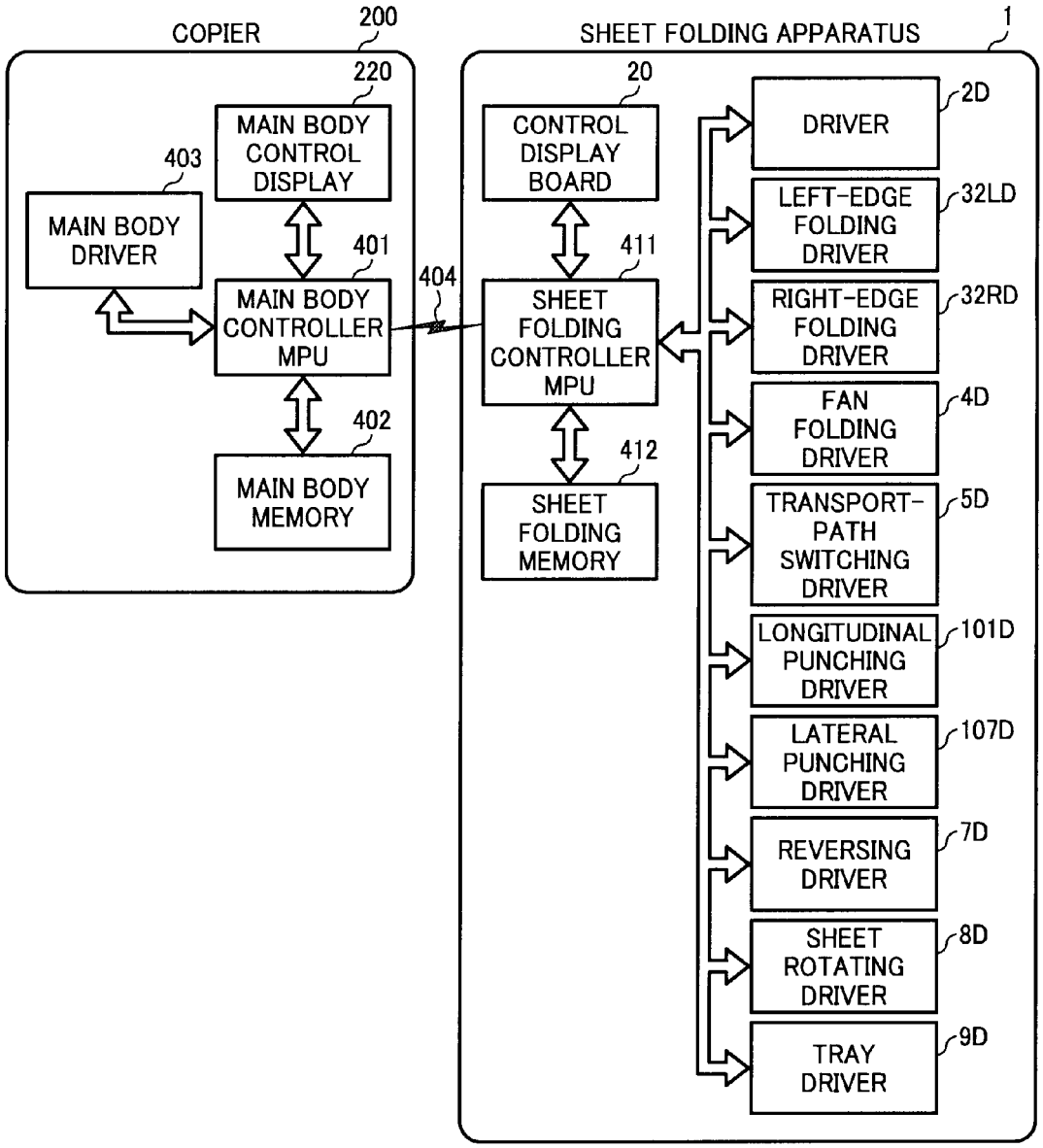
FIG. 8 is a block diagram of an overview of an electrical system of the sheet folding apparatus shown in FIG. 1.

FIG. 8 is an overview of an electrical system that controls constituents of the copier 200 and the sheet folding apparatus 1. The copier 200 includes a main body controller MPU 401 and a main body memory 402 for storing conditions related to copying and folding. The control display board 220 is connected to the main body controller MPU 401 so that conditions related to copying and folding selected on the control display board 220 are stored in the main body memory 402 via the main body controller MPU 401. Main body drivers 403, such as various motors, a fusing heater, and the like for operating the copier 200, are also connected to the main body controller MPU 401 and controlled thereby.

As in the case of the copier 200, the sheet folding apparatus 1 includes a sheet folding controller MPU 411, a sheet folding memory 412, and a sheet folding drivers (not shown). The main body controller MPU 401 and the sheet folding controller MPU 411 are serially connected with a serial cable 404, thereby allowing exchange of various information on the copier 200 and the sheet folding apparatus 1 in serial communication. The MPU referred to here is a microcomputer that includes a CPU, RAM, ROM, input/output ports, and other digital devices or an electrical circuit.

The drivers 2D, 32LD, . . . , and 9D are drivers of which operating mode is specified by the sheet folding controller MPU 411 and operated according to timing control performed by the same, as well as are drive controllers including drivers that energize the CPU, a sensor interface or other input/output interfaces, actuators (motor, solenoid, clutch), and the like. Each of the drivers 2D, 32LD, . . . , and 9D drives a corresponding one of the various mechanisms.

Figure 9:
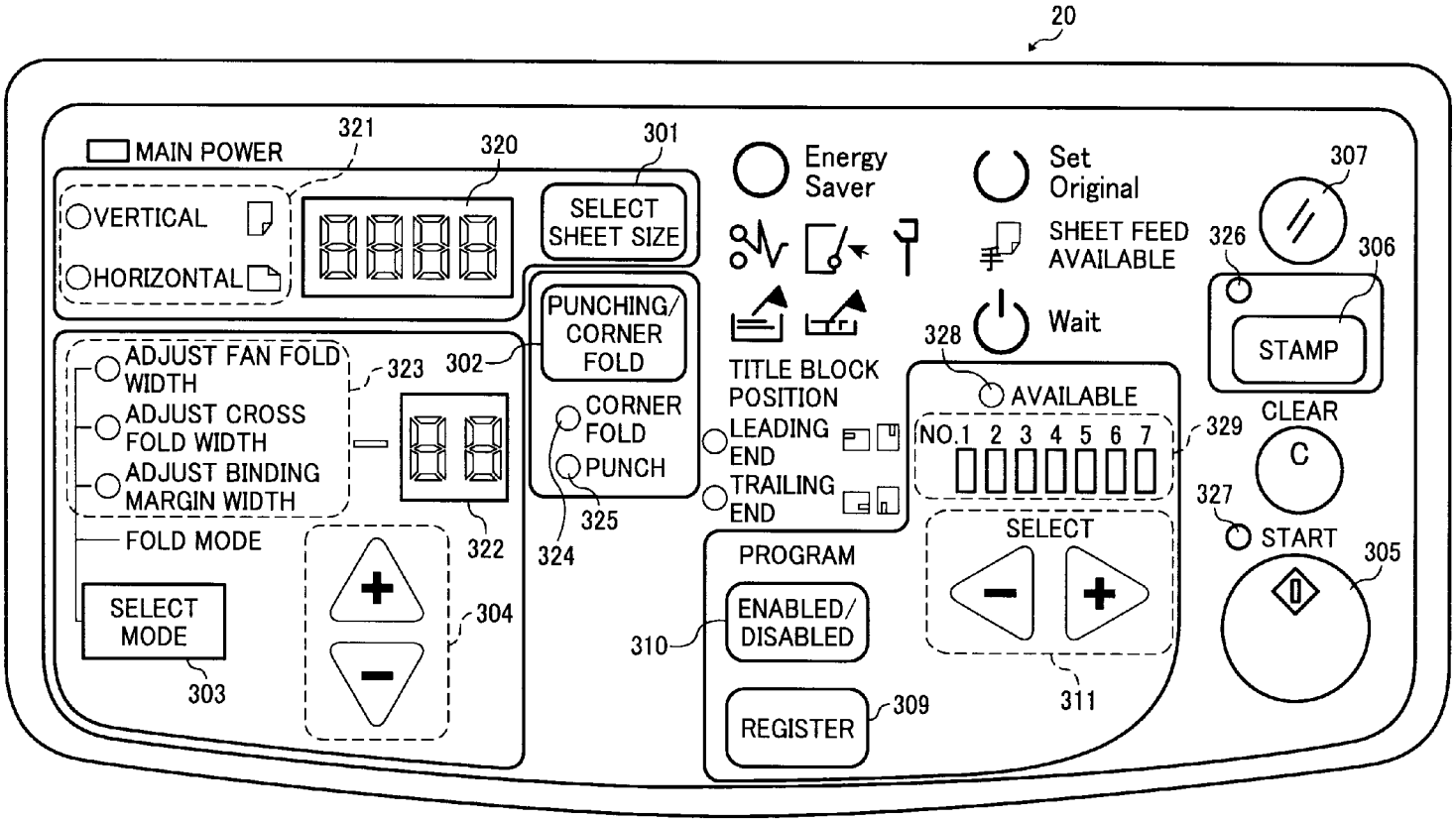
FIG. 9 is an enlarged plan view of a control display board shown in FIGS. 1 and 2.

FIG. 9 depicts a control panel of the control display board 20 provided on the sheet folding apparatus 1. The control display board 20 includes as input units: a sheet-size selecting button 301 with which a size of a sheet to be folded is selected; a set of punching/corner-fold buttons 302 with which corner fold or punching is selected; a set of number-increment/decrement buttons 304 with which a value for each of a finished fold style (fold type), adjustment of a finished size of fan fold, adjustment of a finished size of cross fold, and adjustment of a binding margin width, is input; a mode selecting button 303 with which an input mode for the number-increment/decrement buttons 304 is switched; a stamp button 306 with which whether to print a stamp is selected; a start button 305 that prompts to start sheet folding when pressed; a program registration button 309 with which programmed folding is preset; a program-registration enabled/disabled button 310; a set of program number increment/decrement buttons 311; and a transfer button 307 for transferring information on the conditions related to sheet folding stored in the sheet folding memory 412 to the main body memory 402.

The control display board 20 includes, as indicators indicating settings related to operations: a sheet size indicator 320 that indicates a selected sheet size; a sheet orientation indicator 321 that indicates whether the sheet is to be fed in vertical orientation or horizontal orientation to the sheet feeder 1; a fold mode indicator 322 that indicates one of a selected fold type, a correction value for a finished fan-fold size, a correction value for a finished cross-fold size, and a correction value for a binding margin; a fold mode indicator 323 that indicates which value is indicated in the fold mode indicator 322; a corner fold indicator 324 that indicates whether corner fold is selected; a punching indicator 325 that indicates whether punching is selected; a stamping indicator 326 that indicates whether stamping is selected; a start indicator 327 that indicates that, in response to an interruption of sheet folding in "offline fold" mode, the sheet folding apparatus 1 has reached a point at which it is ready to start folding of the sheet, and prompts to press the start button 305; a programmed-fold available indicator 328 that indicates whether programmed fold is available; and a folding-program number indicator 329 that indicates a number of a selected folding program.

Figure 10:
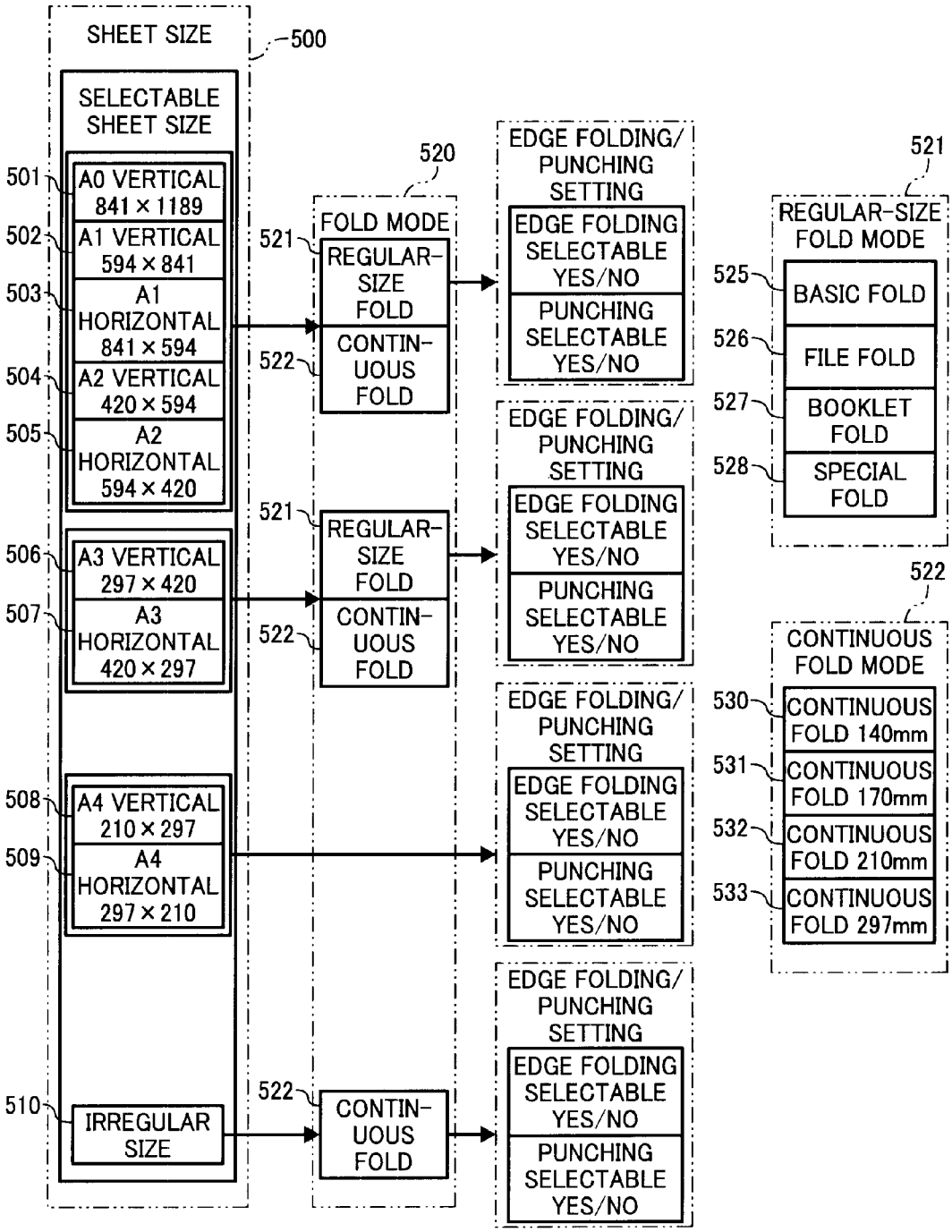
FIG. 10 is a diagram of correspondences among sheet sizes, edge folding, and punching to be processed by the sheet folding apparatus shown in FIG. 1.

FIG. 10 depicts sheet sizes and finishing processing types that can be processed by the sheet folding apparatus 1. FIG. 11 depicts correspondences among sheet sizes, need/no-need of edge folding, and selection of the puncher (longitudinal or lateral) to be applied to a sheet to be folded into the regular size, or A4, for filing the sheet in an A4-size folder.

As indicated by reference numeral 500 in FIG. 10, a sheet size (500) can be selected from a plurality of standard sheet sizes, such as A0 vertical (501), A1 vertical (502), A1 horizontal (503), A2 vertical (504), A2 horizontal (505), A3 vertical (506), A3 horizontal (507), A4 vertical (508), A4 horizontal (509) and irregular size (510) on the control display board 220 shown in FIG. 1. For each of sheets of A0, A1, A2, and A3 vertical and A1, A2, and A3 horizontal, either a regular-size fold mode (521) or a continuous fold mode (522) can be selected as the fold mode (520).

As the regular-size fold mode (521), basic fold (525), file fold (526), booklet fold (527), special fold (528), and the like can be selected. In the regular-size fold mode, a sheet is fan folded to have fold lines perpendicular to the transport direction, and then cross folded to have fold lines perpendicular to the fan-folded lines.

In contrast thereto, a fold mode in which a sheet is fan folded is referred to as the continuous fold mode (522). In the continuous fold mode, a sheet is folded simply into a width of 140 millimeters (530), 170 millimeters (531), 197 millimeters (532), 297 millimeters (533), or the like. Hence, the continuous fold mode can be applied not only to standard-size sheets but also to irregular-sized sheets.

When the regular-size fold mode (521) is selected for a standard-size sheet (A0, A1, or A2 (501 to 503)), whether to perform edge folding for folding a leading end edge of the sheet, and whether to cause the puncher to perform punching can be selected. When punching is selected for a sheet of one of the above standard sizes and the fold type, the sheet is automatically set to receive edge folding.

When the regular-size fold mode (521) is selected for a standard-size A3 sheet (506, 507), edge folding is unnecessary for the sheet. Accordingly, edge folding cannot be selected, while only whether to perform punching can be selected for the sheet. That is, selecting edge folding is inhibited.

When the regular size A4 (508, 509) is selected as the sheet size, a fold mode and edge folding cannot be selected for the sheet, while only whether to perform punching can be selected.

When a start key on the control display board 220 is pressed, information on selection and settings related to the sheet folding apparatus 1 input by a user on the control display board 220 of the copier 200 is transmitted from the copier 200 to the sheet folding controller MPU 411. The sheet folding controller MPU 411 stores the information in its internal RAM or the sheet folding memory 412. When the start key 305 on the control display board 20 is pressed, the sheet folding controller MPU 411 stores the information on selection and settings related to sheet folding input by the user on the control display board 20 of the sheet folding apparatus 1 in its internal RAM or the sheet folding memory 412.

Figure 12:
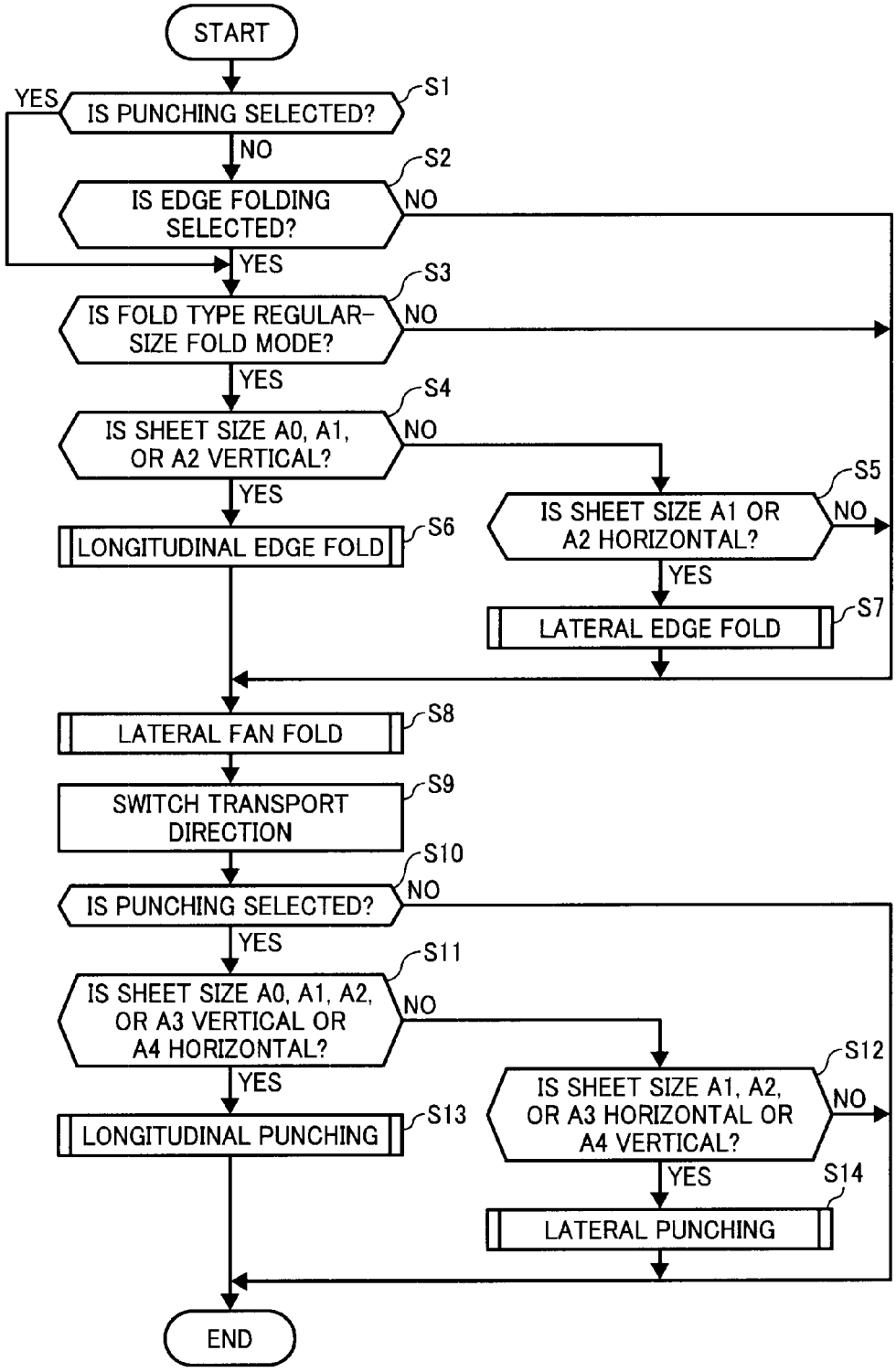
FIG. 12 is a flowchart of control operations from an edge folding step to a punching step performed by a sheet folding controller shown in FIG. 8.

FIG. 12 depicts selective use of the left-edge folding mechanism 32L and the right-edge folding mechanism 32R and that of the longitudinal puncher 101 and the lateral puncher 107 according to a sheet size performed by the sheet folding controller MPU 411. When a sheet is fed from the copier 200 to the connecting transport path 2, or when the start key 305 on the control display board 20 is pressed in a condition in which the sheet size sensor 14 detects a sheet inserted into the horizontal manual-feed port 15, the sheet folding controller MPU 411 starts sheet folding control. More specifically, the sheet folding controller MPU 411 actuates a transport motor. Simultaneously, the sheet folding controller MPU 411 refers to the stored information on selection and settings related to sheet folding for information as to whether punching is selected and whether edge folding is selected (steps S1, S2). In the following, each step will be indicated only by its step identification number with the term "step" omitted from parentheses.

When punching or edge folding is selected and the regular-size fold is selected as the fold mode, the sheet folding controller MPU 411 refers to the sheet size. When the sheet size is any one of A0, A1, and A2 vertical, the sheet folding controller MPU 411 causes the left-edge folding mechanism 32L to perform a longitudinal edge-folding process (S6), thereby putting a crease in a left corner on the leading end of the sheet (S3, S4, S6). When the sheet size is either one of A1 or A2 horizontal, the sheet folding controller MPU 411 causes the right-edge folding mechanism 32R to perform a lateral edge-folding process (S7), thereby putting a crease at a right corner on the leading end of the sheet (S3, S4, S5, S7). For a sheet of other than the above sizes, the edge folding process is skipped, and the sheet is transported to the fan folding mechanism 4.

Figure 13:
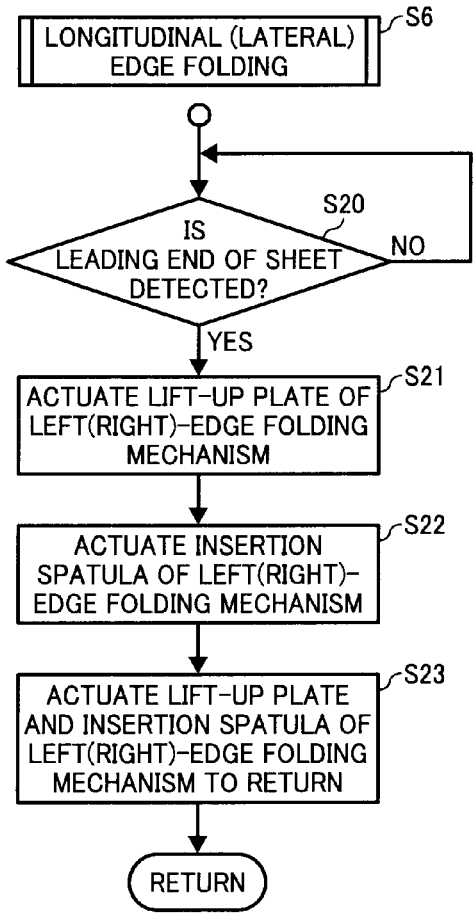
FIG. 13 is a flowchart of details of a longitudinal edge-folding process (S6) in FIG. 12.

FIG. 13 is a flowchart of the longitudinal edge-folding process (S6). When the sheet sensor 38 detects a leading end of a sheet transported to the edge folding stage, the left-edge folding driver 32LD rotates the lift-up plate 34L of the left-edge folding mechanism 32L in a direction to stand upright (S20, S21), and subsequently causes the insertion spatula 36L to pivot toward the nip portion between the roller pair 31. As a result, the left corner on the leading end of the sheet is folded in a triangular shape, and nipped between the roller pair 31 from a corner of the triangular shape close to the center line Lbc. Thus, the triangular folded portion passes through the roller pair 31. Thereafter the left-edge folding driver 32LD actuates the insertion spatula 36L to return to its home position. When the trailing end of the sheet passes through the roller pair 31, the left-edge folding mechanism 32L drives the lift-up plate 34L to return to its original orientation. The lateral edge-folding process (S7) is identical with the longitudinal edge-folding process (S6) other than that the right-edge folding driver 32RD folds back the right corner on the leading end of the sheet.

Referring to FIG. 12 again, the sheet passed through the edge folding stage is conveyed to the fan folding mechanism 4, at which the sheet is fan folded in a fan fold mode corresponding to its sheet size among the fold modes (520), of which correspondences are shown in FIG. 10. The transport-path switching mechanism 5 corrects skewing of the fan-folded sheet, and conveys the sheet in the horizontal direction C (S9). During the process, whether punching is selected is referred to (S10). When punching is selected, for a sheet of A0, A1, A2, or A3 vertical or A4 horizontal, a longitudinal punching process (S13) is performed; that is, the sheet is punched by the longitudinal puncher 101 (see, e.g., FIG. 6). For a sheet of A1, A2, or A3 horizontal or A4 vertical, a lateral punching process (S14) is performed; that is, the sheet is punched by the lateral puncher 107 (see, e.g., FIG. 7). For a sheet other than the above sizes, punching is not performed, and the sheet is transported to the cross folding mechanism 6 (S11—end).

Figure 14:
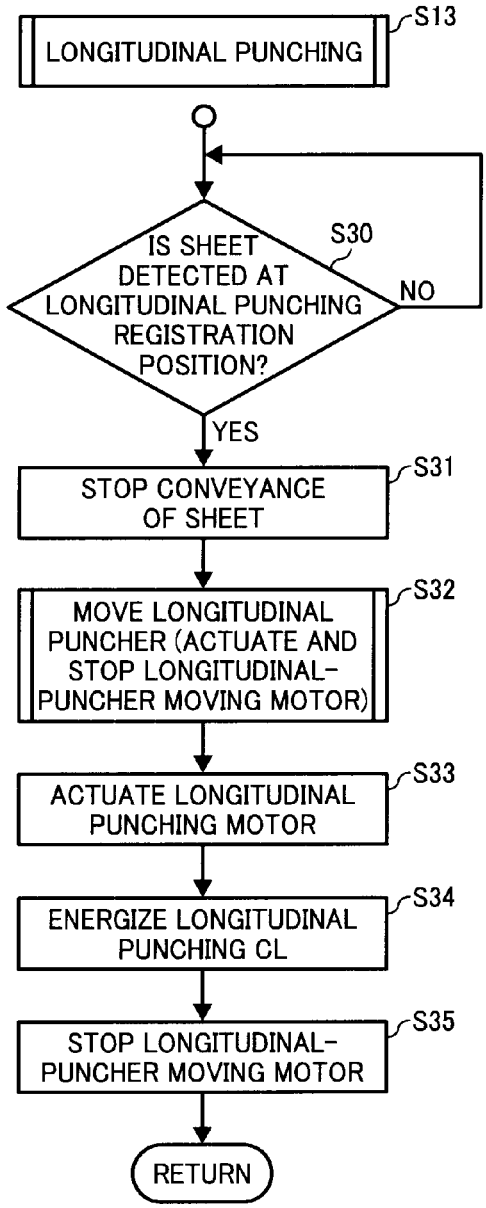
FIG. 14 is a flowchart of details of a longitudinal punching process (S13) in FIG. 12.

FIG. 14 is a flowchart of the longitudinal punching process (S13). The longitudinal punching process is performed by a longitudinal punching driver 101D in response to an instruction supplied from the sheet folding controller MPU 411. When the thus-transported sheet reaches a registration position for lateral punching, the sheet sensor 105 detects the leading end of the sheet, which causes the longitudinal punching driver 101D to stop conveyance of the sheet in the direction C (S30, S31). Subsequently, a drive motor for a longitudinal-puncher drive rotator is actuated (thereby rotating the screw rod 104 forward), to move the longitudinal puncher 101 to a punching position (S32). At the punching position, a punching motor in the longitudinal puncher 101 is actuated, and a punching clutch (CL) is energized to punch holes in the sheet (S33, S34). When punching is completed, the punching motor is stopped, and the drive motor is actuated backward (thereby rotating the screw rod backward) to cause the longitudinal puncher 101 to return to a retracted position (S35).

FIG. 6 is an example in which a sheet of A1 vertical is folded by the left-edge folding mechanism 32L and punched by the longitudinal puncher 101. FIG. 6 is a plan view of the lateral transport-path surface 51 in the horizontal direction C as viewed from above the sheet folding apparatus 1 shown in FIG. 2. When a sheet is of A1 vertical, the sheet is folded at its left corner on the leading end in the longitudinal edge-folding process (S6) shown in FIG. 12, and fan folded (S8). The longitudinal puncher 101 punches a pair of (two) holes in the thus-fan-folded sheet A1T indicated by a long dashed double-dotted line in FIG. 6.

Figure 15:
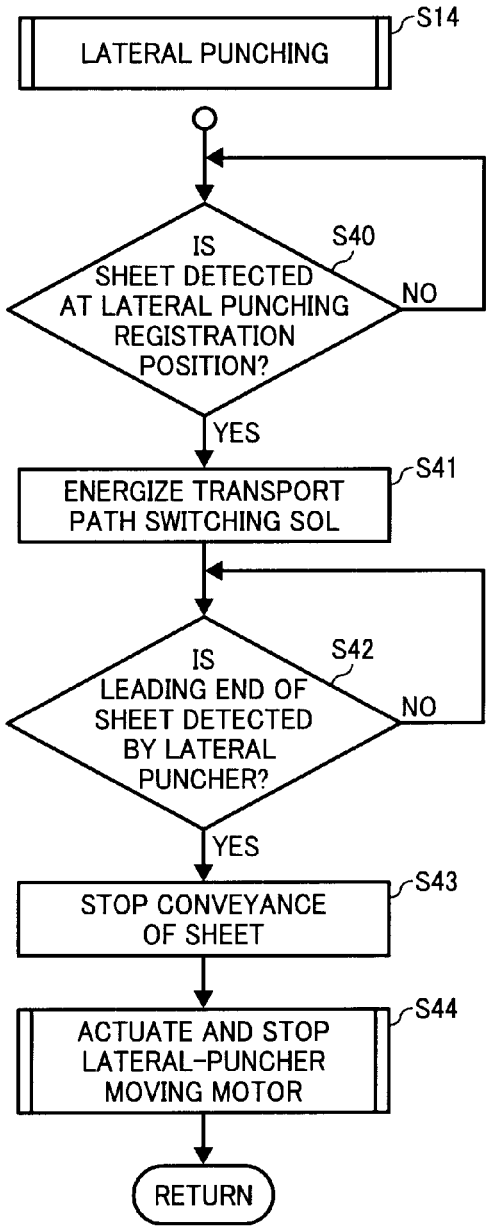
FIG. 15 is a flowchart of details of a lateral punching process (S14) in FIG. 12.

FIG. 15 is a flowchart of the lateral punching process (S14). The lateral punching process is performed by a lateral punching driver 107D in response to an instruction supplied from the sheet folding controller MPU 411. When the sheet sensor 105 detects the leading end of the sheet that is transported in the direction C (S40), the lateral punching driver 107D energizes a transport-path switching solenoid (SOL) of a lug rotating driver of the lateral puncher 107. This energization causes the path switching lugs 106 to tilt up into the orientation indicated by the dotted line in FIG. 5 to guide the sheet to the downward transport path (S41). When a sheet sensor (not shown) provided in the lateral puncher 107 detects the leading end of the sheet, the lateral punching driver 107D stops conveyance of the sheet (S42, S43). A punching motor of the lateral puncher 107 is actuated to perform punching in the sheet, and then to transport the sheet backward. When the leading end of the sheet passes below the sheet sensor 105, the punching motor is stopped (S44).

FIG. 7 is an example in which a sheet of A2 horizontal is folded by the right-edge folding mechanism 32R and punched by the lateral puncher 107. When a sheet is of A2 horizontal, the sheet is folded at its right corner on the leading end in the lateral edge-folding process (S7), and fan folded (S8). The lateral puncher 107 punches a pair of (two) holes in the thus-fan-folded sheet A2Y indicated by a long dashed double-dotted line in FIG. 7.

The sheet folding controller MPU 411 transports a sheet punched by the puncher 101 or 107, or a sheet that has not been punched because no punching is selected therefor immediately below the sheet sensor 105 to the cross folding mechanism 6 shown in FIG. 2. In the cross folding mechanism 6, the sheet is folded into the A4 size to have fold lines perpendicular to the fan-folded lines. The sheet thus folded into the A4 size passes through the reversing mechanism 7 and the rotating mechanism 8 shown in FIG. 1, and discharged onto the tray 9 through the stamper 30.

When a variety of large, standard-size sheets are to be folded into the regular size, e.g., A4 size, for filing in a regular-size folder, a binding margin in which the fan-folded sheet is to be punched can be either parallel with or perpendicular to the sheet transport direction, depending on the size of the sheet. According to the embodiment, when the binding margin in which the sheet is to be punched is parallel with the transport direction, the sheet is punched by a first puncher 101, 101D, whereas when the binding margin is perpendicular to the transport direction, the sheet is punched by a second punching unit 107, 107D. More specifically, by selectively using either the first punching unit 101, 101D or the second punching unit 107, 107D, a sheet to be folded can be punched at filing positions for a regular-size file irrespective of a size and orientation (vertical or horizontal) of the sheet. Thus, the invention allows to punch holes in any one of a variety of, large standard-size sheets. Because the need of rotating a large-size sheet about an axis orthogonal to a sheet plane by 90 degrees is eliminated, the apparatus can be prevented from being increased in size to allow sheet rotation by 90 degrees.

According to the embodiment, filing holes can be punched in a fan-folded sheet of any of several sheet sizes when a binding margin of the sheet, in which the holes are to be punched, is parallel with a transport direction of the sheet. That is, the sheet folding apparatus can punch holes in a variety of large standard-size sheets.

According to the embodiment, the second punching unit 107, 107D is located below the lateral transport-path surface 51. That is, the second punching unit 107, 107D is three-dimensionally positioned to be lower than the first punching unit 101, 101D. In addition, a required length for the transport path (the downward transport path in the embodiment) of which direction is switched by the path switching lugs 106 is such a length that allows the leading end of the sheet to be inserted in the second punching unit 107, 107D from the lateral transport-path surface 51. Hence, the transport path can be set short, thereby reducing the size of the entire punching device 3.

When a variety of large, standard-size sheets are to be folded into a regular size for filing in a regular-size folder, a binding margin, in which the fan-folded sheet is to be punched, can be either parallel with or perpendicular to the sheet transport direction, depending on the size of the sheet. According to the embodiment, when the binding margin in which the sheet is to be punched is parallel with the transport direction, the sheet can be punched by a first punching unit 101, 101D, whereas when the binding margin is perpendicular to the transport direction, the sheet can be punched by the second punching unit 107, 107D. However, by the punching, also a portion of the sheet to be folded over the portion to be punched is also perforated, which damages the sheet. The portion to be damaged by punching is a left corner or a right corner on a leading end, relative to a transport direction of the sheet, of the sheet of a state before being subjected to fan folding.

According to the embodiment, damage that can otherwise be caused by punching holes in the sheet can be avoided by folding back a left corner of the sheet using the first edge-folding unit 32L, 32LD or a right corner using the second edge-folding unit 32R, 32RD. That is, by selectively using either the first punching unit 101, 101D or the second punching unit 107, 107D, a sheet to be folded can be punched at filing positions for a regular-size folder irrespective of a size and orientation (vertical or horizontal) of the sheet. Thus, the invention allows to punch holes through any one of a variety of, large standard-size sheets without damaging the sheet.

According to the embodiment, holes can be punched in any one of a variety of, large standard-size sheets without damaging the sheet. Because the need of rotating a large-size sheet about an axis orthogonal to a sheet plane by 90 degrees is eliminated, the apparatus can be prevented from being increased in size to allow sheet rotation by 90 degrees.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet folding apparatus comprising:

an edge folding unit that folds back a portion on a leading end of a delivered sheet that is to be folded into a regular size and perforated with a filing hole to file the sheet in a regular-size folder, wherein the portion would otherwise block a portion to be punched when the sheet has been folded;

a fan folding unit that fan folds the folded-back sheet into a width and length of the regular size to file the sheet in the regular-size folder such that the sheet forms layers along a traveling direction of the sheet;

a first punching unit that punches the filing hole in the sheet fan folded into the width of the regular size at the portion to be punched to file the sheet in the regular-size folder;

a second punching unit that punches the filing hole in the sheet fan folded into the length of the regular size at the portion to be punched for filing in the regular-size folder;

a sheet-processing setting unit that sets a fold mode of the fan fold and selects one of the first punching unit and the second punching unit for use in punching of the filing hole in the sheet based on conditions stored in a memory, the conditions including a size and an orientation of the sheet; and a corner-fold transport path that transports the delivered sheet while aligning a center line thereof with a center line of the corner-fold transport path, wherein the edge folding unit includes a first edge-folding unit that folds a left corner on the leading end of the delivered sheet in relation to the center line of the corner-fold transport path and a second edge-folding unit that folds a right corner on the leading end of the delivered sheet in relation to the center of the corner-fold transport path, and the sheet-processing setting unit selects one of the first edge-folding unit and the second edge-folding unit for use in the corner fold based on the size and orientation of the delivered sheet.

2. The sheet folding apparatus according to claim 1, further comprising a transport unit that transports the fan-folded sheet fed out from the fan folding unit along a lateral transport-path surface in a lateral direction perpendicular to a direction in which the sheet is fed out from the fan folding unit, wherein the first punching unit includes a puncher that punches a plurality of holes arranged in the lateral direction and a drive unit that moves the puncher back and forth in a direction along the lateral transport-path surface and perpendicular to the lateral direction.

3. The sheet folding apparatus according to claim 2, further comprising a path switching unit that selectively switches a transport direction of the fan-folded sheet conveyed on the lateral transport-path surface in the lateral direction to a direction perpendicular to the lateral transport-path surface, wherein the second punching unit includes a fixedly positioned puncher that receives the leading end of the sheet of which the transport direction has been switched by the path switching unit to punch a plurality of holes arranged in a direction perpendicular to the transport direction.

4. The sheet folding apparatus according to claim 1, further comprising a cross folding unit that folds the sheet into the length or width of the regular size, the cross folding unit being provided on a downstream transport route transporting the sheet past a position of the punching units to a tray.

5. The sheet folding apparatus according to claim 1, further comprising a reversing unit that interchanges the leading end and a trailing end of the sheet relative to the transport direction, the reversing unit being provided on a downstream transport route transporting the sheet past a position of the punching units to a tray.

6. The sheet folding apparatus according to claim 1, further comprising a rotating unit that rotates the orientation of the sheet by 90 degrees relative to the transport direction, the rotating unit being provided on a downstream transport route transporting the sheet past a position of the punching units to a tray.

7. A sheet folding apparatus comprising:

an edge folding unit that folds back a portion on a leading end of a delivered sheet that is to be folded into a regular size and perforated with a filing hole to file the sheet in a regular-size folder, wherein the portion would otherwise block a portion to be punched when the sheet has been folded;

a fan folding unit that fan folds the folded-back sheet into a width and length of the regular size to file the sheet in the regular-size folder such that the sheet forms layers along a traveling direction of the sheet;

a first punching unit that punches the filing hole in the sheet fan folded into the width of the regular size at the portion to be punched to file the sheet in the regular-size folder;

a second punching unit that punches the filing hole in the sheet fan folded into the length of the regular size at the portion to be punched for filing in the regular-size folder;

a sheet-processing setting unit that sets a fold mode of the fan fold and selects one of the first punching unit and the second punching unit for use in punching of the filing hole in the sheet based on conditions stored in a memory, the conditions including a size and an orientation of the sheet; and a stamper that prints information on the sheet, the stamper being provided on a downstream transport route transporting the sheet past a position of the punching units to a tray.

8. The sheet folding apparatus according to claim 1, further comprising:

a horizontal feed port for allowing manual fed of a sheet; and a manual transport unit that receives the sheet fed into the horizontal feed port, and delivers the sheet to an edge-fold transport path of the edge-folding unit.

9. The sheet folding apparatus according to claim 1, further comprising a connecting transport unit that receives the sheet horizontally discharged from an image forming apparatus, and delivers the sheet to the edge-fold transport path of the edge-folding unit.

10. A sheet folding apparatus comprising:

a corner-fold transport path that transports a delivered sheet in a vertical direction while aligning a center line thereof to a center line of the corner-fold transport path;

a first edge-folding unit that folds back a left corner, in relation to the center line, on a leading end of the sheet that is transported in the vertical direction and to be folded into a regular size and perforated with a filing hole to file the sheet in a regular-size folder, wherein the left corner would otherwise block a portion to be punched when the sheet has been folded;

a second edge-folding unit that folds back a right corner in relation to the center line on the leading end of the vertically transported sheet, wherein the sheet is to be folded into a regular size and perforated with a hole for filing in a regular-size folder, wherein the right corner would otherwise block a portion to be punched when the sheet has been folded;

a fan folding unit that fan folds the folded-back sheet into a width or length of the regular size for filing in the regular-size folder such that the sheet forms layers along a traveling direction of the sheet;

a transport-direction changing unit that changes the transport direction of the sheet having been fan-folded into the width or length of the regular size from the vertical direction to a first horizontal direction and then discharges the sheet;

a transport unit that transports the sheet discharged in the first horizontal direction along a transport path surface extending in a second horizontal direction perpendicular to the first horizontal direction;

a first punching unit that includes a puncher that perforates a plurality of holes arranged in the second horizontal direction and a drive unit that moves the puncher back and forth in a direction along the transport-path surface and perpendicular to the second horizontal direction;

a path switching unit that selectively switches the transport direction of the sheet transported along the transport-path surface in the second horizontal direction to a direction perpendicular to the transport-path surface;

a second punching unit that includes a fixedly positioned puncher, the puncher receiving the leading end of the sheet of which the transport direction has been switched by the path switching unit and punching a plurality of holes arranged in a direction perpendicular to the transport direction; and a sheet-processing setting unit that selects one of the first edge-folding unit and the second edge-folding unit for use in the corner fold, sets a fan fold mode, and selects one of the first punching unit and the second punching unit for use in punching of the filing hole based on conditions stored in a memory, the conditions including a size and an orientation of the sheet.

11. The sheet folding apparatus according to claim 10, further comprising a cross folding unit that folds the sheet into the length or width of the regular size, the cross folding unit being provided on a downstream transport route transporting the sheet past a position of the punching units to a tray.

12. The sheet folding apparatus according to claim 10, further comprising a reversing unit that interchanges the leading end and a trailing end of the sheet relative to the transport direction, the reversing unit being provided on a downstream transport route transporting the sheet past a position of the punching units to a tray.

13. The sheet folding apparatus according to claim 10, further comprising a rotating unit that rotates the orientation of the sheet by 90 degrees relative to the transport direction, the rotating unit being provided on a downstream transport route transporting the sheet past a position of the punching units to a tray.

14. The sheet folding apparatus according to claim 10, further comprising a stamper that prints information on the sheet, the stamper being provided on a downstream transport route transporting the sheet past a position of the punching units to a tray.

15. The sheet folding apparatus according to claim 10, further comprising:

a horizontal feed port for allowing manual fed of a sheet; and a manual transport unit that receives the sheet fed into the horizontal feed port, and delivers the sheet to an edge-fold transport path of the edge-folding unit.

16. The sheet folding apparatus according to claim 10 further comprising a connecting transport unit that receives the sheet horizontally discharged from an image forming apparatus, and delivers the sheet to the edge-fold transport path of the edge-folding unit.

17. An image forming apparatus comprising:

the sheet folding apparatus according to claim 1; and a connecting transport unit that receives the sheet horizontally discharged from an imaging device, and delivers the sheet to an edge-fold transport path of the edge-folding unit, wherein the imaging device forms an image on a sheet larger than the regular size and outputs the sheet with image to the connecting transport unit.

18. The image forming apparatus according to claim 17, wherein the imaging device is a copier.

* * * * *